US010570542B2

(12) United States Patent
Catallo

(10) Patent No.: US 10,570,542 B2
(45) Date of Patent: Feb. 25, 2020

(54) APPARATUS AND METHOD FOR PRE-SHRINKING A WET FABRIC PRIOR TO DRYING

(71) Applicant: Teresa Catallo, Old Westbury, NY (US)

(72) Inventor: Frank Catallo, Old Westbury, NY (US)

(73) Assignee: Teresa Catallo, Old Westbury, NY (US)

( * ) Notice: Subject to any disclaimer, the term of this patent is extended or adjusted under 35 U.S.C. 154(b) by 443 days.

(21) Appl. No.: 14/994,278

(22) Filed: Jan. 13, 2016

(65) Prior Publication Data

US 2017/0198426 A1 Jul. 13, 2017

(51) Int. Cl.

| | |
|---|---|
| ***D06B 15/00*** | (2006.01) |
| ***D06C 21/00*** | (2006.01) |
| ***D06B 21/00*** | (2006.01) |
| ***D06B 15/02*** | (2006.01) |
| ***D06C 5/00*** | (2006.01) |
| ***D06C 27/00*** | (2006.01) |
| ***D06F 11/00*** | (2006.01) |
| ***D06F 33/02*** | (2006.01) |
| ***D06F 39/00*** | (2020.01) |
| ***D06F 39/02*** | (2006.01) |

(Continued)

(52) U.S. Cl.

CPC ..... *D06C 21/00* (2013.01); *D06B 15/00* (2013.01); *D06B 15/02* (2013.01); *D06B 21/00* (2013.01); *D06C 5/00* (2013.01); *D06C 27/00* (2013.01); *D06F 11/00* (2013.01); *D06F 33/02* (2013.01); *D06F 39/008* (2013.01); *D06F 39/02* (2013.01); *D06F 39/045* (2013.01); *D06F 45/22* (2013.01); *D06F 89/00* (2013.01)

(58) Field of Classification Search

CPC . D06C 21/00; D06C 5/00; D06B 3/18; D06B 23/023; D06P 7/00; D06F 39/002; D06F 39/022; D06F 39/008

USPC ..... 26/18.5; 8/151; 271/258.01; 68/9, 22 R, 68/13 R

See application file for complete search history.

(56) References Cited

U.S. PATENT DOCUMENTS 1,829,378 A * 10/1931 Thiriet ..... D21C 9/083 162/40

1,893,197 A * 1/1933 Cohn ..... D06C 5/00 8/151

(Continued)

*Primary Examiner* — Sally Haden

*Assistant Examiner* — Jillian K Pierorazio

(74) *Attorney, Agent, or Firm* — Charles E. Baxley

(57) ABSTRACT

An apparatus and method for pre-shrinking a wet fabric prior to drying. The apparatus includes, among other components, a balloon extractor station and a hydro-sizer compression station. The balloon extractor station removes some water from the wet fabric. The hydro-sizer compression station is operatively connected to, and disposed downstream of, the balloon extractor station, and compresses the wet fabric in a lengthwise direction, and in so doing, pre-shrinks the wet fabric prior to drying. The method includes, among other steps, extracting some water from the wet fabric so as to faun a hydro-extracted and wet fabric, compressing lengthwise the hydro-extracted and wet fabric so as to form a compacted and wet fabric that is now pre-shrunk prior to drying, and drying the compacted and wet fabric so as to form a compacted and dry fabric.

16 Claims, 9 Drawing Sheets

(51) Int. Cl.

| | |
|---|---|
| ***D06F 39/04*** | (2006.01) |
| ***D06F 45/22*** | (2006.01) |
| ***D06F 89/00*** | (2006.01) |

(56) References Cited

U.S. PATENT DOCUMENTS 2,338,983 A * 1/1944 Thackston ..... D06C 7/02 26/18.5
2,748,381 A * 5/1956 Baker ..... D06H 3/10 200/61.13
2,759,324 A * 8/1956 Dean ..... D06B 23/08 57/1 UN
3,015,145 A 1/1962 Cohn
3,116,621 A * 1/1964 Klein ..... D04B 35/10 250/559.45
3,548,616 A * 12/1970 Catallo ..... D06B 3/18 26/97
3,723,161 A * 3/1973 Fleissner ..... B44C 1/24 427/278
3,730,679 A * 5/1973 Schuierer ..... D06B 9/00 8/151
3,801,252 A * 4/1974 Waterhouse ..... D01D 5/423 425/304
3,819,325 A * 6/1974 Bates ..... D06B 3/201 8/151
3,958,432 A * 5/1976 Aronoff ..... D06B 3/105 26/51
3,978,696 A * 9/1976 Ito ..... D06B 3/201 68/158
4,031,596 A * 6/1977 Joy ..... D06C 21/00 26/18.6
4,159,632 A * 7/1979 Grantham ..... D06F 15/00 271/258.01
4,199,966 A * 4/1980 Winch ..... D06B 3/02 68/158
4,204,290 A * 5/1980 Jilla ..... D02G 1/00 427/274
4,306,495 A * 12/1981 Grantham ..... D06F 95/00 100/37
4,329,838 A * 5/1982 Zerle ..... D06B 23/08 57/1 UN
4,369,231 A * 1/1983 West ..... C09D 183/04 26/18.6
4,412,435 A * 11/1983 Gallagher ..... D06F 31/00 198/819
4,434,633 A * 3/1984 Winch ..... D06B 15/02 68/22 R
4,441,882 A * 4/1984 Gallagher ..... D06F 31/00 68/158
4,532,782 A * 8/1985 Sellers ..... D06B 3/18 68/13 R
4,562,627 A * 1/1986 Milligan ..... D06C 5/00 26/18.5
4,575,909 A * 3/1986 O'Brien ..... D06C 21/00 26/18.6
4,631,911 A * 12/1986 Young, Jr. ..... D06B 23/08 26/51
4,644,765 A * 2/1987 Kito ..... D06B 3/201 68/158
4,843,669 A * 7/1989 Koch ..... D06B 3/105 8/151
4,882,819 A 11/1989 Milligan
4,922,567 A * 5/1990 Miller ..... D06B 3/16 68/13 R
4,947,501 A * 8/1990 Koch ..... D06B 23/28 118/694
5,010,612 A * 4/1991 Jensen ..... D06B 3/105 8/149.1
5,016,329 A 5/1991 Milligan
5,046,208 A * 9/1991 Catallo ..... D06B 1/147 68/13 R
5,058,402 A * 10/1991 Vecchia ..... D06B 3/18 68/181 R
5,126,946 A * 6/1992 Ko ..... B65H 23/0204 226/15
5,172,443 A * 12/1992 Christ ..... D06B 1/02 68/189
5,271,131 A * 12/1993 Jacumin ..... D06B 23/08 26/74
5,477,890 A * 12/1995 Krummheuer ..... B60R 21/235 139/291 R
5,480,485 A * 1/1996 McClain ..... D06M 11/61 118/300
5,546,622 A * 8/1996 McAlister ..... D06B 1/02 68/205 R
5,634,226 A * 6/1997 Oschatz ..... D06B 3/105 68/205 R
5,666,704 A * 9/1997 Price ..... D06B 23/08 26/51
5,718,107 A * 2/1998 Catallo ..... D06B 23/08 26/71
5,826,289 A * 10/1998 Catallo ..... D06B 3/105 8/152
5,826,314 A * 10/1998 Aihara ..... B29C 55/08 26/88
6,047,483 A 4/2000 Allison
6,381,996 B1 * 5/2002 Chang ..... D06B 3/24 68/178
6,681,461 B1 1/2004 Catallo
6,950,717 B1 * 9/2005 Pierce ..... D06C 21/00 26/74
8,590,122 B2 11/2013 West
8,814,953 B1 * 8/2014 Abbott ..... D06P 7/00 8/499
9,416,474 B2 * 8/2016 Catallo ..... D06B 1/147
2002/0198091 A1 * 12/2002 Catallo ..... B65H 45/105 493/442
2005/0000032 A1 * 1/2005 Albrecht ..... D06B 3/16 8/152
2005/0015889 A1 * 1/2005 Zikeli ..... D06B 1/16 8/156
2009/0149095 A1 * 6/2009 Sano ..... D06M 11/78 442/59
2012/0233826 A1 * 9/2012 West ..... D06C 21/00 26/18.5
2014/0053343 A1 * 2/2014 Poy ..... D06F 31/00 8/137
2016/0059258 A1 * 3/2016 Hanel ..... D06B 1/142 118/58

* cited by examiner

| LOT # | STYLE # | YARN | FINISHED WIDTH | COLOR | CPI AFTER PAD | COMP. % WET | WIDTH AFTER COMP. WET |
|---|---|---|---|---|---|---|---|
| | | | | | | | |
| 860362 | 36247 JERSEY | 30/1 S COTTON | 20″ | TROPHY GOLD | 47 | 13% | 20% |
| | | | | | | | |
| 864869 | 36247 JERSEY | 30/1 S COTTON | 18″ | NAVY | 48 | 18% | 18% |
| | | | | | | | |
| 860228 | 36247 SM JERSEY | 30/1 S COTTON | 20″ | LIGHT BLUE | 47 | 19% | 20 1/4% |
| | | | | | | | |
| 860234 | 36247 JERSEY | 30/1 S COTTON | 24 1/2″ | LIGHT BLUE | 43-44 | 18% | 24 1/2% |
| | | | | | | | |
| 839138 | 36247 JERSEY | 30/1 S COTTON | 20″ | ROYAL | 44 | 16% | 19 3/4% |

| CPI AFTER COMP. WET | WIDTH AFTER DRYING | CPI AFTER DRYING | WIDTH AFTER COMP. DRY | COMP % DRY | CPI AFTER COMP. DRY | FABRIC WEIGHT | WASH TEST TORQUE | WASH TEST SHRINKAGE |
|---|---|---|---|---|---|---|---|---|
| | | | | | | | | |
| 51-52 | 20″ | 51-52 | 20″ | 8% | 52 | 4.47 | 7.6 | -3.4 L x -2.9 W |
| | | | | | | | | |
| 51.5 | 17.5″ | 52 | 18 1/4″ | 10% | 53-54 | 4.77 | 4.7 | +1.19 x -5.4 W |
| | | | | | | | | |
| 52.5 | 19 1/4″ | 51 | 20″ | 10% | 52.5 | 4.6 | 7.3 | -2.2 L x -3.5 W |
| | | | | | | | | |
| 48-49 | 23 3/4″ | 47-48 | 24 1/2″ | 14% | 51-52 | 4.62 | 5.6 | -2.6 L x -2.7 W |
| | | | | | | | | |
| 48-49 | 19 1/4″ | 48 | 20″ | 8% | 53 | 4.57 | 5.5 | -0.4 L x -5.78W |

FIG. 6

APPARATUS AND METHOD FOR PRE-SHRINKING A WET FABRIC PRIOR TO DRYING

CROSS REFERENCE TO RELATED APPLICATIONS

The instant non-provisional patent application claims priority from provisional patent application No. 62/283,862, filed on Sep. 11, 2015, for PRE-SHRINKING OF FABRIC IN WET CONDITION, and incorporated herein in its entirety by reference thereto.

BACKGROUND OF THE INVENTION

Field of the Invention

The embodiments of the present invention relate to an apparatus and method for shrinking a fabric, and more particularly, the embodiments of the present invention relate to an apparatus and method for pre-shrinking a wet fabric prior to drying.

Description of the Prior Art

Garment producers and other manufactures are continuously trying to lower acceptable standards of shrinkage in 100% cotton and cotton/synthetic blended fabrics and apparel. Typically, a finished fabric standard of not more than −5% length x −5% width is allowable, and further typically, finished garment shrinkage standards usually are not more than −8% length x −8% width.

These results can be obtained with proper knitting and finishing processes. Now, the standards for garments and apparel are being lowered to −3% to −4% length shrinkage x−3% to −4% width shrinkage by several major U.S. producers.

Fabric producers are unable to obtain the finished fabric shrinkage results to meet these standards without chemical fixation, through the use of resins. Many resins are, however, objectionable from a cost stand point, as well as health concerns because certain resins have been shown to produce cancer. Further, mechanical compaction of the fabric reduces the lengthwise shrinkage of the fabric without chemicals, but the new standards cannot be met by the prior art.

Numerous innovations for compressively treating fabrics have been provided in the prior art, which will be described below in chronological order to show advancement in the art, and which are incorporated herein in their entirety by reference thereto. Even though these innovations may be suitable for the specific individual purposes to which they address, nevertheless, they differ from the embodiments of the present invention in that they do not teach an apparatus and method for pre-shrinking a wet fabric prior to drying.

U.S. Pat. No. 3,015,145—issued to Cohn et al. on Jan. 2, 1962 in U.S. class 26 and subclass 18.6—teaches a method of compressively treating fibrous web material, which includes the steps of feeding the material in a positive manner and at a first predetermined uniform speed substantially to an entry line of a treating zone by closely confining both principle surfaces of the material to a predetermined path during the feeding, discontinuing the positive feeding and the close confining substantially at the entry line, retarding the material to a second predetermined uniform speed at an exit line of the treating zone, whereby the material is caused to decelerate and decreases in length and thereby increases in thickness in passage through the zone, and subjecting the material to heat and substantial localized pressure at the exit line of the treating zone. The increased thickness of the material is substantially greater than that of the predetermined path, whereby decelerating portions of the fabric are confined substantially to the treating zone. The predetermined path is of a length several times larger than the length of the treating zone.

U.S. Pat. No. 4,562,627—issued to Milligan on Jan. 7, 1986 in U.S. class 26 and subclass 18.5—teaches a process for finish drying of tubular knitted fabrics from a wet condition to a substantially finished form in a single process. Wet treated and mechanically extracted fabric is significantly overspread laterally as it enters the upstream end of the dryer, and although already wet, the fabric is steamed. Thereafter, and throughout most of its travel through the dryer system, the fabric is handled to avoid stitch tension to the greatest possible extent, while the wet fabric is assuming geometric stability. The discharged fabric is virtually finished and ready for the cutting table. Mechanical roller compacting of fabrics in a wet condition enables the wet-compacted fabric to be dried to a substantially finished condition without significant loss of its compacting.

U.S. Pat. No. 4,882,819—issued to Milligan et al. on Nov. 28, 1989 in U.S. class 26 and subclass 18.6—teaches a method for compressive lengthwise shrinking of tubular knitted fabrics and other materials, particularly, in a single stage. Feeding and retarding rollers are separated from each other by a distance significantly greater than the thickness of the fabric. Zone-forming blades are projected between the rollers from opposite sides and form therebetween a confinement zone that extends at a large angle from the feeding roller to the retarding roller. Fabric is guided to the zone under low contact pressure by the feeding roller and is conveyed away from the zone under similarly low contact pressure by the retarding roller. At the entrance to the zone, the fabric is decelerated and compacted lengthwise without burnishing or abrasion and without crimping. Tubular and open width knitted fabrics can be compressively pre-shrunk in large amounts up to 25% and more in a single stage.

U.S. Pat. No. 5,016,329—issued to Milligan et al. on May 21, 1991 in U.S. class 26 and subclass 18.5—teaches an apparatus for compressive lengthwise shrinking of tubular knitted fabrics and other materials, particularly, in a single stage. Feeding and retarding rollers are separated from each other by a distance significantly greater than the thickness of the fabric. Zone-forming blades are projected between the rollers from opposite sides and form therebetween a confinement zone that extends at a large angle from the feeding roller to the retarding roller. Fabric is guided to the zone under low contact pressure by the feeding roller and is conveyed away from the zone under similarly low contact pressure by the retarding roller. At the entrance to the zone, the fabric is decelerated and compacted lengthwise without burnishing or abrasion and without crimping. Tubular and open width knitted fabrics can be compressively pre-shrunk in large amounts up to 25% and more in a single stage.

U.S Pat. No. 6,047,483—issued to Allison et al. on Apr. 11, 2000 in U.S. class 34 and subclass 128—teaches a heating system for a mechanical compressive shrinkage apparatus in which a continuously flowing liquid heat-exchange medium is caused to flow in series through each of the components required to be heated. Heat is inputted to the flowing medium in accordance with the temperature of one of the components to be heated, preferably, the first in the series. Uniformity and constancy of both absolute and relative temperatures of the series-connected components is achieved. A mixture of water and propylene glycol alcohol is the heat-exchange medium that allows operation at lower pressure without the maintenance problems of a system using, for example, oil as the exchange medium.

U.S. Pat. No. 6,681,461 B1—issued to Catallo on Jan. 27, 2004 in U.S. class 26 and subclass 18.6—teaches a method and apparatus for shrink-proofing a fabric, typically, a knitted textile composed of interlocked loops of yarn made of at least one of natural and man-made fibers. The loops interlock along stitch rows that may become skewed. The fabric is confined from expanding as it is delivered to, and discharged from, an in-line compression zone free of obstructions, such as, one of crimps, bends, and kinks. The fabric is confined, preferably, resiliently coming to, passing through, and leaving, the compression zone so as to accommodate variations of thickness and irregularities of the fabric being compacted in the compression zone. The interlocked loops are organized, whereby they are allowed to move toward each other orthogonally along their related stitch row so as to reduce volume of the fabric. Non-woven textiles, papers, papers with additives, and the like are shrink-proofed in the same manner.

U.S. Pat. No. 8,590,122 B2—issued to West et al. on Nov. 26, 2013 in U.S. class 26 and subclass 18.6—teaches a two-stage process and apparatus for compacting tubular knitted fabrics. At each stage, the fabric is acted upon by cooperating feeding and retarding rollers that are spaced-apart a distance greater than the thickness of the fabric. Thus, opposite fabric sides cannot be in simultaneous contact with the feeding and retarding rollers at the same point along the fabric. Fabric is transferred from the feeding roller to the retarding roller, while opposite sides of the fabric are closely confined in a compacting zone, free of contact with either roller. Fabric is longitudinally compacted during its traverse of that zone. In the second stage, the rollers are reversely oriented with respect to the fabric. Not more than 60% of the compacting effort is imparted in either one of the stages. Preferably, each stage imparts about 50% of the compacting effort.

It is apparent that numerous innovations for compressively treating fabrics have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a method and apparatus for pre-shrinking a wet fabric prior to drying.

SUMMARY OF THE INVENTION

Thus, an object of the embodiments of the present invention is to provide an apparatus and method for pre-shrinking a wet fabric prior to drying, which avoids the disadvantages of the prior art.

Passing a knit fabric in tubular or open form through mechanical compression or a compacting station in the "wet" state prior to drying, in order to provide lengthwise compression of the fabric, increases the stitches or courses per inch and re-orients the knit construction to reduce residual shrinkage in the finished fabric and garments.

The definition of "wet" is the amount of residual moisture present in the fabric prior to processing, which can range from 30-300%. The residual moisture includes one of water and any mixture of water and process chemicals.

Briefly stated, another object of the embodiments of the present invention is to provide an apparatus and method for pre-shrinking a wet fabric prior to drying. The apparatus includes, among other components, a balloon extractor station and a hydro-sizer compression station. The balloon extractor station removes some water from the wet fabric. The hydro-sizer compression station is operatively connected to, and disposed downstream of, the balloon extractor station, and compresses the wet fabric in a lengthwise direction, and in doing so, pre-shrinks the wet fabric prior to drying. The method includes, among other steps, extracting some water from the wet fabric so as to form a hydro-extracted and wet fabric, compressing lengthwise the hydro-extracted and wet fabric so as to form a compacted and wet fabric that is now pre-shrunk prior to drying, and drying the compacted and wet fabric so as to form a compacted and dry fabric.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

BRIEF DESCRIPTION OF THE FIGURES OF THE DRAWING

The figures of the drawing are briefly described as follows:

FIG. 6 is a tabulation of initial test results achieved by the apparatus and method of the embodiments of the present invention.

LIST OF REFERENCE NUMERALS UTILIZED IN THE FIGURES OF THE DRAWING

Introductory

Figure 1:
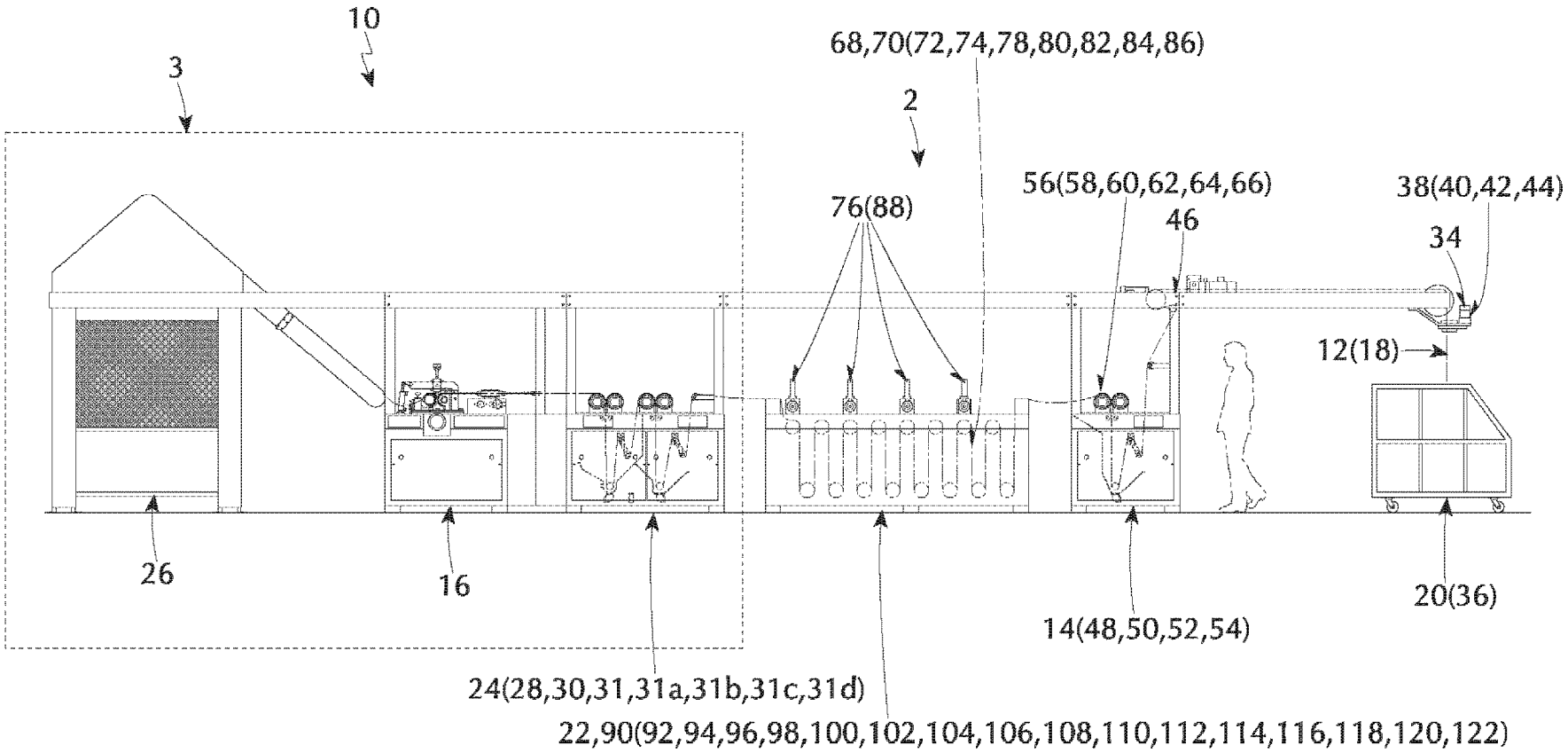
FIG. 1 is a diagrammatic side elevational view of the apparatus of the embodiments of the present invention.

10 apparatus of embodiments of present invention for pre-shrinking wet fabric 12 prior to drying
12 wet fabric

Overall Configuration of Apparatus 10 for Pre-shrinking Wet Fabric 12 Prior to Drying

14 balloon extractor station for removing some water 18 from wet fabric 12
16 hydro-sizer compression station for compressing wet fabric 12 in lengthwise direction, and in doing so, pre-shrinks wet fabric 12 prior to drying
18 water of wet fabric 12

20 entry system station
22 knit washer station
24 twin balloon pad station for padding on one of chemical softeners 28 and lubricants 30 and for removing excess water 18 and excess of one of chemical softeners 28 and lubricants 30 from wet fabric 12
26 folding station
28 chemical softeners
30 chemical lubricants
31 non-ionic of one of chemical softeners 28 and chemical lubricants 30
31*a* cationic of one of chemical softeners 28 and chemical lubricants 30
31*b* polyethylene of one of chemical softeners 28 and chemical lubricants 30
31*c* silicone of one of chemical softeners 28 and chemical lubricants 30
31*d* soil and stain release agents of one of chemical softeners 28 and chemical lubricants 30

Specific Configuration of Entry System Station 20

32 48" hydraulic turntable of entry system station 20
34 twist sensor of entry system station 20 for automatic de-twisting
36 driven cloth lifter of entry system station 20 for automatic de-twisting
38 motorized pot-eye de-twister of entry system station 20
40 "O" ring guiders of entry system station 20
42 powered width control of "O" ring guiders 40 of entry system station 20
44 hole detectors of "O" ring guiders 40 of entry system station 20

Specific Configuration of Balloon Extractor Station 14

46 driven feed roll of balloon extractor station 14 for drawing wet fabric 12 through ring guides 48 of balloon extractor station 14 and into pre-wet extracting scary 50 of balloon extractor station 14
48 ring guides of balloon extractor station 14
50 pre-wet extracting scary of balloon extractor station 14
52 extracting scray of balloon extractor station 14 for automatic speed control and air for ballooning wet fabric 12
54 idler/dancer assembly of extracting scray 52 of balloon extractor station 14
56 pair of extracting squeeze rolls of balloon extractor station 14
58 metal of each extracting squeeze roll of pair of extracting squeeze rolls 56 of balloon extractor station 14
60 metal core of each extracting squeeze roll of pair of extracting squeeze rolls 56 of balloon extractor station 14
62 polyurethane of each extracting squeeze roll of pair of extracting squeeze rolls 56 of balloon extractor station 14
64 rubber of each extracting squeeze roll of pair of extracting squeeze rolls 56 of balloon extractor station 14
66 other synthetic compounds of each extracting squeeze roll of pair of extracting squeeze rolls 56 of balloon extractor station 14

Specific Configuration of Knit Washer Station 22

68 continuous washing chamber of knit washer station 22
70 eight individual compartments of continuous washing chamber 68 of knit washer station 22
72 eight immersion rolls of eight individual compartments 70 of continuous washing chamber 68 of knit washer station 22
74 eight carrier rolls of eight individual compartments 70 of continuous washing chamber 68 of knit washer station 22
76 four nip roll assemblies of eight individual compartments 70 of continuous washing chamber 68 of knit washer station 22
78 two directional rolls of eight individual compartments 70 of continuous washing chamber 68 of knit washer station 22
80 displacement baffles of eight individual compartments 70 of continuous washing chamber 68 of knit washer station 22
82 air injection assemblies of eight individual compartments 70 of continuous washing chamber 68 of knit washer station 22
84 compartment drains of eight individual compartments 70 of continuous washing chamber 68 of knit washer station 22
86 overflow drains of eight individual compartments 70 of continuous washing chamber 68 of knit washer station 22
88 pneumatic loading of four nip roll assemblies 76 of eight individual compartments 70 of continuous washing chamber 68 of knit washer station 22
90 PH system of knit washer station 22
92 acid circulation pump of PH system 90 of knit washer station 22
94 electronic metering pump of PH system 90 of knit washer station 22
96 integral piping of PH system 90 of knit washer station 22
98 PH probe of PH system 90 of knit washer station 22
100 transmitter of PH probe 98 of PH system 90 of knit washer station 22
102 soap dispensing system of knit washer station 22
104 electronic metering pump of soap dispensing system 102 of knit washer station 22
106 integral piping of soap dispensing system 102 of knit washer station 22
108 water heating system of knit washer station 22
110 heat exchanger of water heating system 108 of knit washer station 22 for providing 25 gallons (95 liters) per minute capacity at 160° F. (70° C.)
112 steam control valve of water heating system 108 of knit washer station 22
114 RTD of steam control valve 112 of water heating system 108 of knit washer station 22 for water temperature measurement in continuous washing chamber 68 of knit washer station 22
116 temperature controller of water heating system 108 of knit washer station 22
118 piping of water heating system 108 of knit washer station 22
120 fittings of water heating system 108 of knit washer station 22
122 control valve transducer of temperature controller 116 of water heating system 108 of knit washer station 22

Specific Configuration of Twin Balloon Pad Station 24

124 extracting scray of twin balloon pad station 24 for automatic speed control and air for ballooning wet fabric 12
126 idler/dancer assembly of extracting scray 124 of twin balloon pad station 24

128 pair of extracting squeeze rolls of twin balloon pad station 24
130 chemical application pan of twin balloon pad station 24
132 processing scray of twin balloon pad station 24 for automatic speed control
134 idler/dance assembly of processing scray 132 of twin balloon pad station 24
136 pair of padding rolls of twin balloon pad station 24
138 solution controller of twin balloon pad station 24 for automatic control of volume of one of chemical softeners 28 and chemical lubricants 30
140 after-spreaders of twin balloon pad station 24
142 pair of spreaders of after-spreaders 140 of twin balloon pad station 24
144 powered width change of pair of spreaders 142 of after-spreaders 140 of twin balloon pad station 24
146 hole detectors of pair of spreaders 142 of after-spreaders 140 of twin balloon pad station 24
148 metal of each extracting squeeze roll of pair of extracting squeeze rolls 128 of twin balloon pad station 24 and each padding roll of pair of padding rolls 136 of twin balloon pad station 24
150 metal core of each extracting squeeze roll of pair of extracting squeeze rolls 128 of twin balloon pad station 24 and each padding roll of pair of padding rolls 136 of twin balloon pad station 24
152 polyurethane of each extracting squeeze roll of pair of extracting squeeze rolls 128 of twin balloon pad station 24 and each padding roll of pair of padding rolls 136 of twin balloon pad station 24
154 rubber of each extracting squeeze roll of pair of extracting squeeze rolls 128 of twin balloon pad station 24 and each padding roll of pair of padding rolls 136 of twin balloon pad station 24
156 other synthetic compounds of each extracting squeeze roll of pair of extracting squeeze rolls 128 of twin balloon pad station 24 and each padding roll of pair of padding rolls 136 of twin balloon pad station 24

Specific Configuration of Hydro-Sizer Compression Station 16

158 edge-drive spreading unit of hydro-sizer compression station 16
160 pair of spreaders of hydro-sizer compression station 16
162 powered width change of pair of spreaders 160 of hydro-sizer compression station 16
164 hole detectors of pair of spreaders 160 of hydro-sizer compression station 16
166 feed roll of hydro-sizer compression station 16
168 retard roll of hydro-sizer compression station 16
170 shoe assembly of hydro-sizer compression station 16 for wet compacting
172 lower impact blade/shoe of shoe assembly 170 of hydro-sizer compression station 16
174 metal of each of feed roll 166 of hydro-sizer compression station 16 and retard roll
168 of hydro-sizer compression station 16
176 metal core of each of feed roll 166 of hydro-sizer compression station 16 and retard roll 168 of hydro-sizer compression station 16
178 polyurethane of each of feed roll 166 of hydro-sizer compression station 16 and retard roll 168 of hydro-sizer compression station 16
180 rubber of each of feed roll 166 of hydro-sizer compression station 16 and retard roll
168 of hydro-sizer compression station 16
182 other synthetic compounds of each of feed roll 166 of hydro-sizer compression station 16 and retard roll 168 of hydro-sizer compression station 16
184 metal of lower impact blade/shoe 172 of shoe assembly 170 of hydro-sizer compression station 16
186 synthetic polymers of lower impact blade/shoe 172 of shoe assembly 170 of hydro-sizer compression station 16

Specific Configuration of Folding Station 26

188 self-adjusting and descending rate-drop table of folding station 26 for controlling distance of travel of wet fabric 12 from top 192 of fabric transport conveyor 190 of folding station 26 to self-adjusting and descending-rate drop table 188 of folding station 26 for preventing compaction percentage of length tension of wet fabric 12 hanging from fabric transport conveyor 190 of folding station 26 from being one of reduced and pulled out
190 fabric transport conveyor of folding station 26 for delivering wet fabric 12 to self-adjusting and descending-rate drop table 188 of folding station 26
192 top of fabric transport conveyor 190 of folding station 26

Method 194 for Pre-Shrinking Wet Fabric 12 Prior to Drying

194 method for pre-shrinking wet fabric 12 prior to drying
195 entered and wet fabric
196 hydro-extracted and wet fabric
198 washed, hydro-extracted, and wet fabric
200 chemically applied, washed, hydro-extracted, and wet fabric
202 excess chemically removed, washed, hydro-extracted, and wet fabric
204 compacted, washed, hydro-extracted, and wet fabric
205 folded, compacted, washed, hydro-extracted, and wet fabric
206 compacted and dry fabric

DETAILED DESCRIPTION OF THE PREFERRED EMBODIMENTS

Introductory

Figure 2:
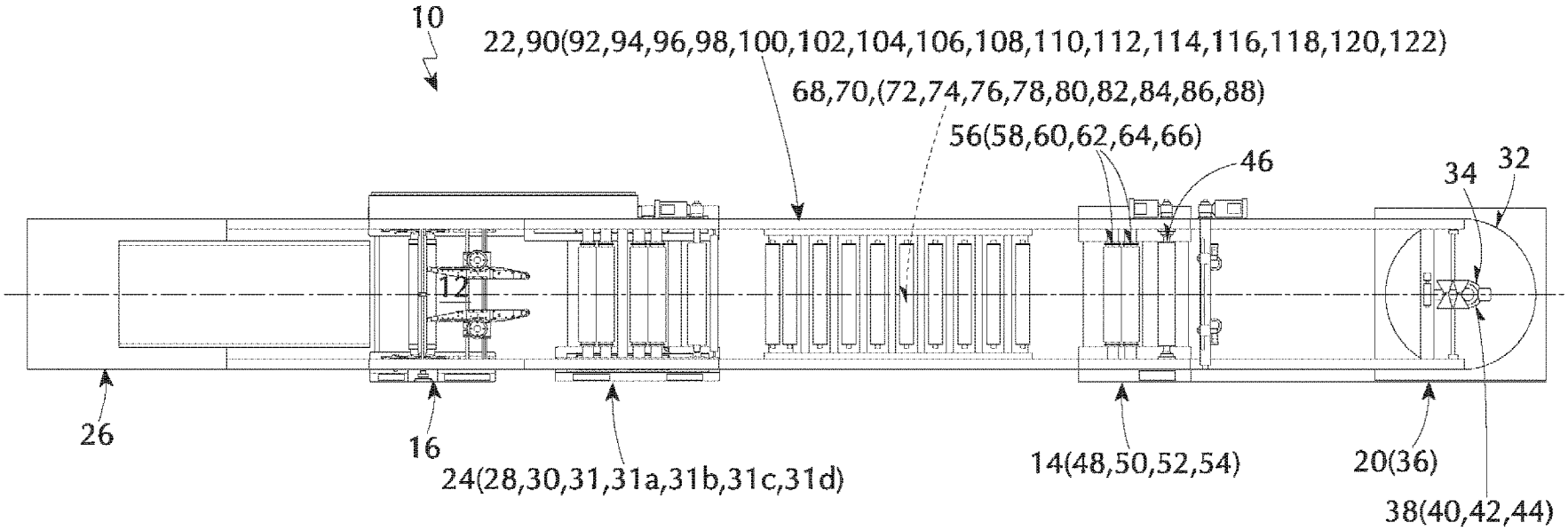
FIG. 2 is a diagrammatic top plan view taken in the direction of ARROW 2 in FIG. 1 of the apparatus of the embodiments of the present invention.

Referring now to the figures, in which like numerals indicate like parts, and particularly to FIGS. 1 and 2, the apparatus of the embodiments of the present invention is shown generally at 10 for pre-shrinking a wet fabric 12 prior to drying.

Overall Configuration of the Apparatus 10 for Pre-shrinking the Wet Fabric 12 Prior to Drying The overall configuration of the apparatus 10 for pre-shrinking the wet fabric 12 prior to drying can best be seen in FIGS. 1 and 2, and as such, will be discussed with reference thereto.

The apparatus 10 comprises a balloon extractor station 14 and a hydro-sizer compression station 16. The balloon extractor station 14 is for removing some water 18 from the wet fabric 12. The hydro-sizer compression station 16 is operatively connected to, and disposed downstream of, the balloon extractor station 14, and is for compressing the wet fabric 12 in a lengthwise direction, and in doing so, pre-shrinks the wet fabric 12 prior to drying.

The apparatus 10 further comprises an entry system station 20, a knit washer station 22, a twin balloon pad station 24, and a folding station 26.

The balloon extractor station 14 is operatively connected to, and disposed downstream of, the entry system station 20.

The knit washer station 22 is operatively connected to, and disposed downstream of, the balloon extractor station 14.

The twin balloon pad station 24 is operatively connected to, and disposed downstream of, the knit washer station 22, and is for padding on one of chemical softeners 28 and chemical lubricants 30 and for removing excess water 18 and excess of the one of the chemical softeners 28 and the chemical lubricants 30 from the wet fabric 12.

The one of the chemical softeners 28 and the chemical lubricants 30 include at least one of non-ionic 31, cationic 31*a*, polyethylene 31*b*, silicone 31*c*, and soil and stain release agents 31*d*.

The hydro-sizer compression station 16 is operatively connected to, and disposed downstream of, the twin balloon pad station 24.

Specific Configuration of the Entry System Station 20

The specific configuration of the entry system station 20 can best be seen in FIGS. 1 and 2, and as such, will be discussed with reference thereto.

The entry system station 20 includes a 48" hydraulic turntable 32 and a twist sensor 34.

The entry system station 20 further includes a driven cloth lifter 36. The driven cloth lifter 36 of the entry system station 20 and the twist sensor 34 of the entry system station 20 are for automatic de-twisting.

The entry system station 20 further includes a motorized pot-eye de-twister 38 and "O" ring guiders 40. The "O" ring guiders 40 of the entry system station 20 have a powered width control 42 and hole detectors 44.

Specific Configuration of the Balloon Extractor Station 14

The specific configuration of the balloon extractor station 14 can best be seen in FIGS. 1 and 2, and as such, will be discussed with reference thereto.

The balloon extractor station 14 includes a driven feed roll 46. The driven feed roll 46 of the balloon extractor station 14 is for drawing the wet fabric 12 through ring guides 48 of the balloon extractor station 14 and into a pre-wet extracting scary 50 of the balloon extractor station 14.

The balloon extractor station 14 further includes an extracting scray 52. The extracting scray 52 of the balloon extractor station 14 is for automatic speed control and air for ballooning the wet fabric 12, and has an idler/dancer assembly 54.

The balloon extractor station 14 further includes a pair of extracting squeeze rolls 56.

Each extracting squeeze roll 56 of the balloon extractor station 14 is made from one of a metal 58 and a metal core 60 covered in one of a polyurethane 62, rubber 64, and other synthetic compounds 66, and has a 7" (17.78 cm) diameter and a 38" (96.52 cm) face.

Specific Configuration of the Knit Washer Station 22

The specific configuration of the knit washer station 22 can best be seen in FIGS. 1 and 2, and as such, will be discussed with reference thereto.

The knit washer station 22 includes a continuous washing chamber 68.

The continuous washing chamber 68 of the knit washer station 22 is made from stainless steel, and has eight individual compartments 70.

The eight individual compartments 70 of the continuous washing chamber 68 of the knit washer station 22 include eight immersion rolls 72, eight carrier rolls 74, four nip roll assemblies 76, two directional rolls 78, displacement baffles 80, air injection assemblies 82, compartment drains 84, and overflow drains 86.

The four nip roll assemblies 76 of the eight individual compartments 70 of the continuous washing chamber 68 of the knit washer station 22 have pneumatic loading 88.

The knit washer station 22 further includes a PH system 90.

The PH system 90 of the knit washer station 22 has an acid circulation pump 92, an electronic metering pump 94, integral piping 96, and a PH probe 98.

The PH probe 98 of the PH system 90 of the knit washer station 22 has a transmitter 100.

The knit washer station 22 further includes a soap dispensing system 102.

The soap dispensing system 102 of the knit washer station 22 has an electronic metering pump 104 and integral piping 106.

The knit washer station 22 further includes a water heating system 108.

The water heating system 108 of the knit washer station 22 has a heat exchanger 110. The heat exchanger 110 of the water heating system 108 of the knit washer station 22 is for providing 25 gallons (95 liters) per minute capacity at 160° F. (70° C.).

The water heating system 108 of the knit washer station 22 further has a steam control valve 112.

The steam control valve 112 of the water heating system 108 of the knit washer station 22 is 1½ and has an RTD 114. The RTD 114 of the steam control valve 112 of the water heating system 108 of the knit washer station 22 is for water temperature measurement in the continuous washing chamber 68 of the knit washer station 22.

The water heating system 108 of the knit washer station 22 further has a temperature controller 116, and piping 118 and fittings 120 to connect the steam control valve 112 of the water heating system 108 of the knit washer station 22 to the continuous washing chamber 68 of the knit washer station 22 with a maximum length of 10' (3 meters).

The temperature controller 116 of the water heating system 108 of the knit washer station 22 has a control valve transducer 122.

Specific Configuration of the Twin Balloon Pad Station 24

Figure 3:
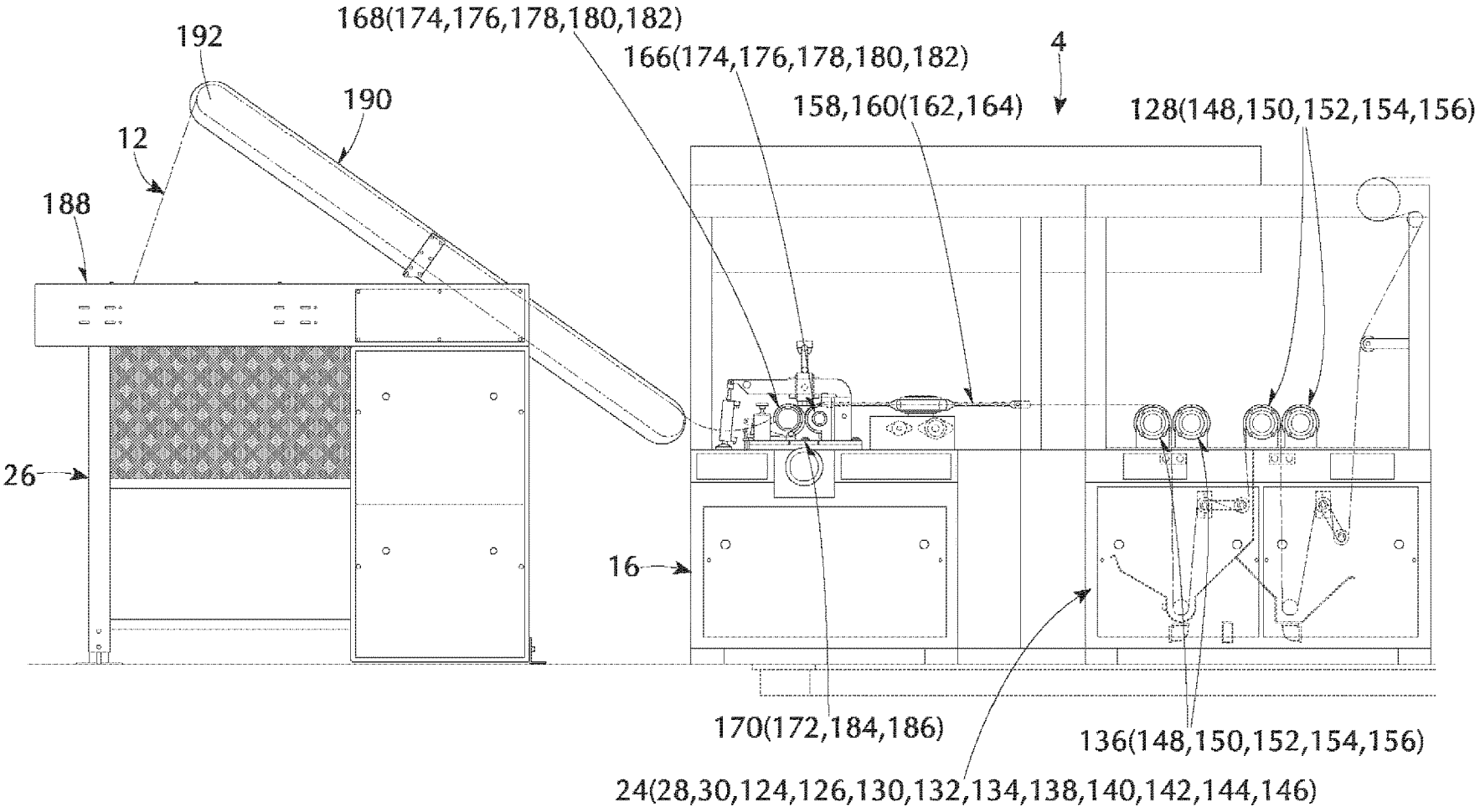
FIG. 3 is an enlarged diagrammatic side elevational view of the area generally enclosed by the dotted curve identified by ARROW 3 in FIG. 1 of the twin balloon pad station, the hydro-sizer compression station, and the folding station of the apparatus of the embodiments of the present invention.
Figure 4:
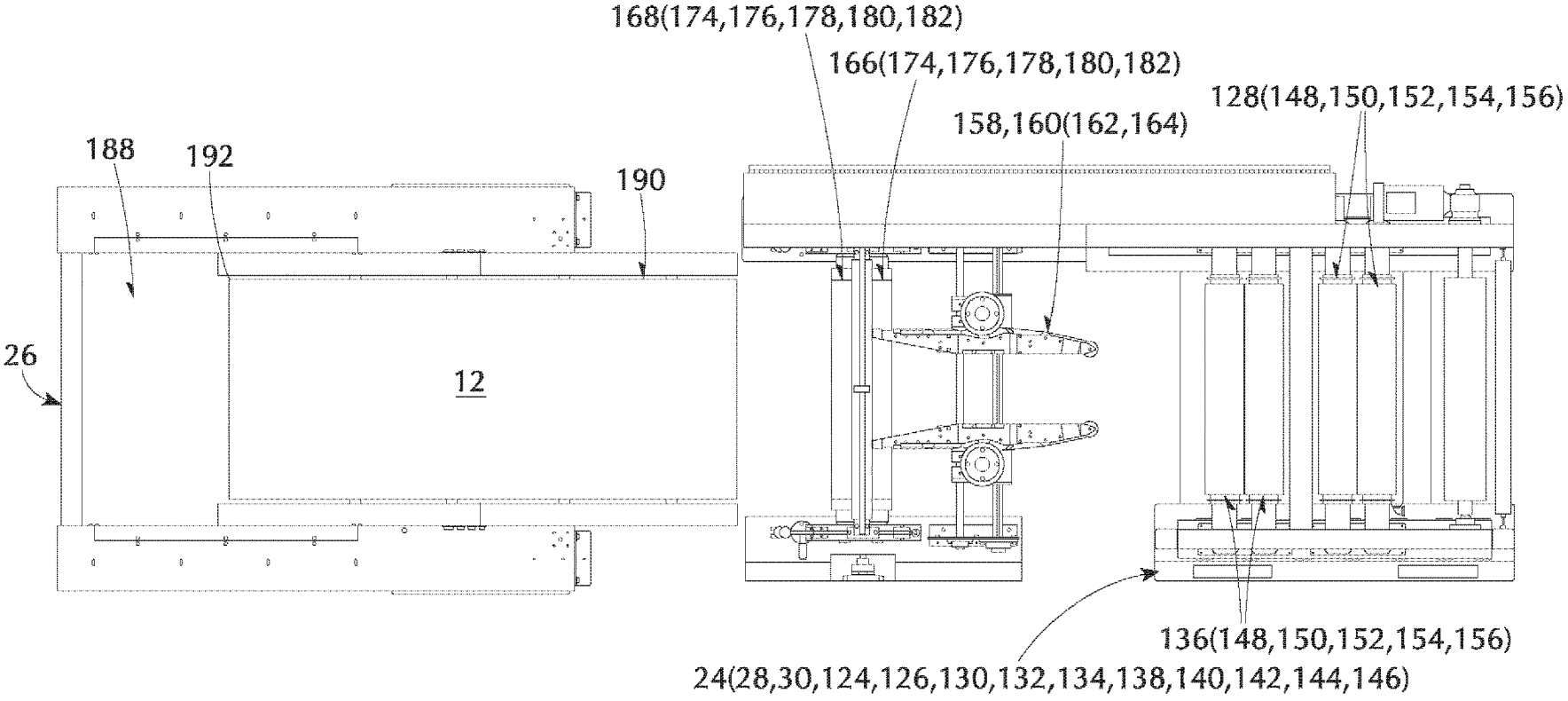
FIG. 4 is a diagrammatic top plan view taken generally in the direction of ARROW 4 in FIG. 3 of the twin balloon pad station, the hydro-sizer compression station, and the folding station of the apparatus of the embodiments of the present invention.
Figure 5A:
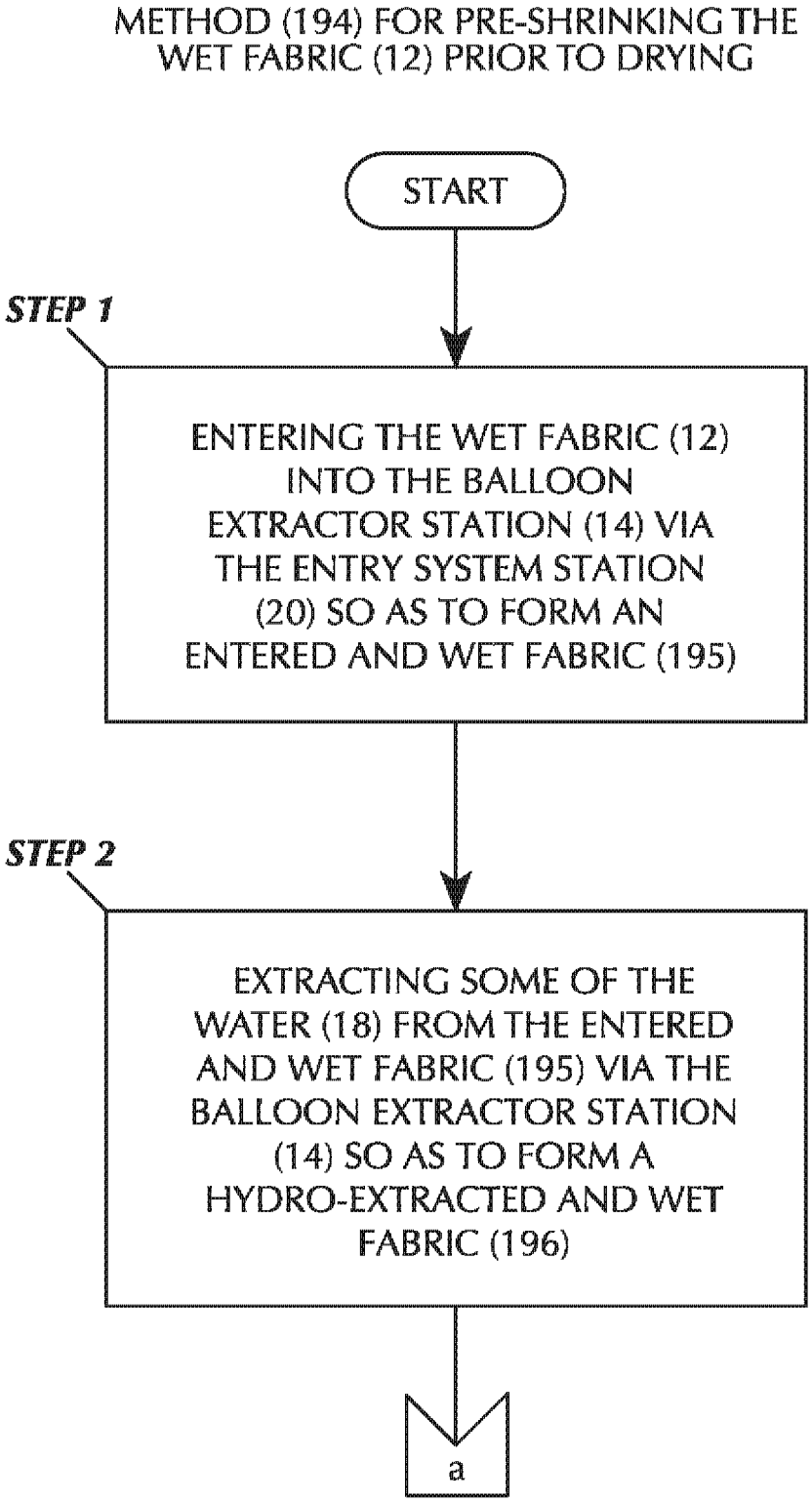
FIGS. 5A-5D are a flowchart of the method of the embodiments of the present invention pre-shrinking a wet fabric prior to drying.
Figure 5B:
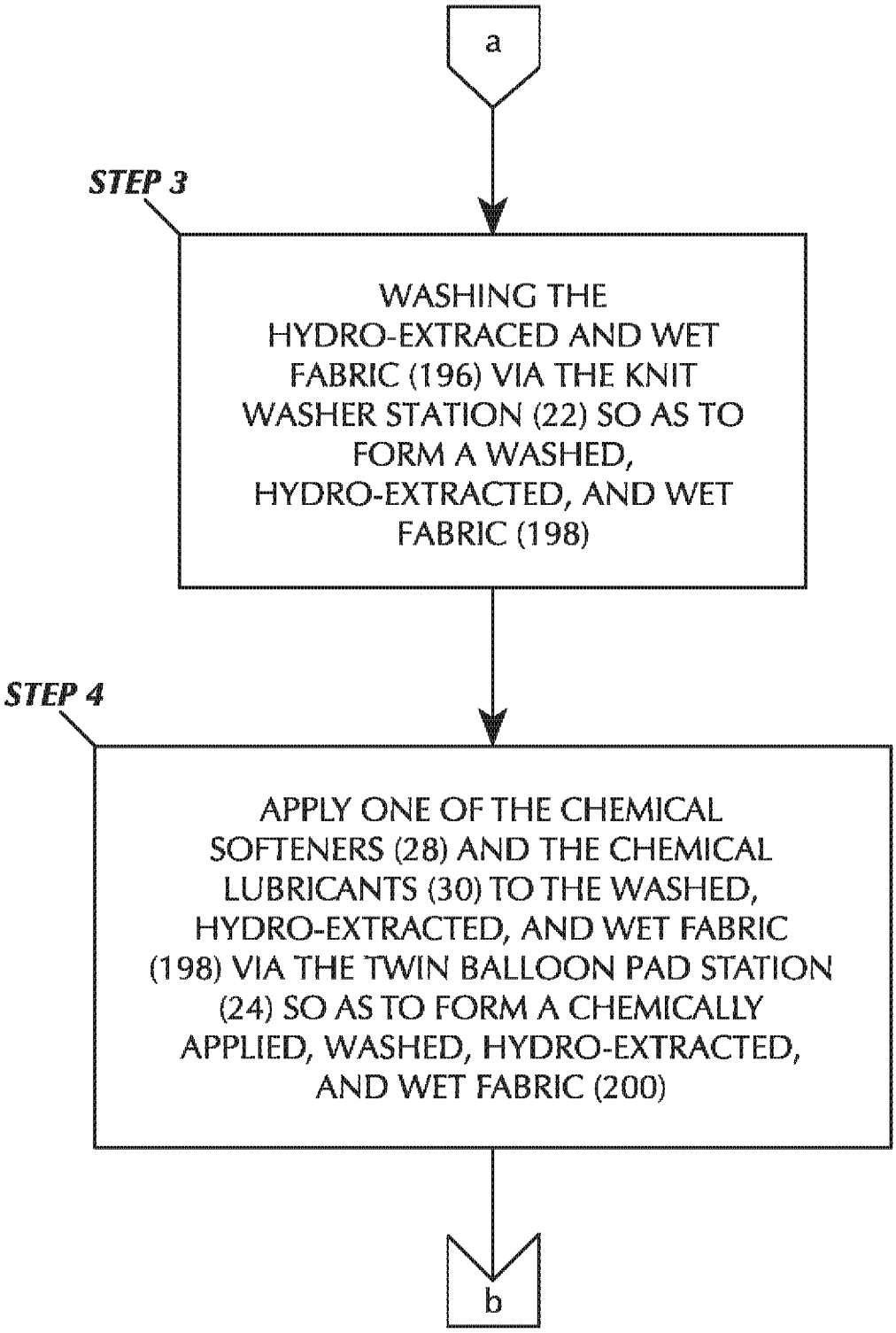
Figure 5C:
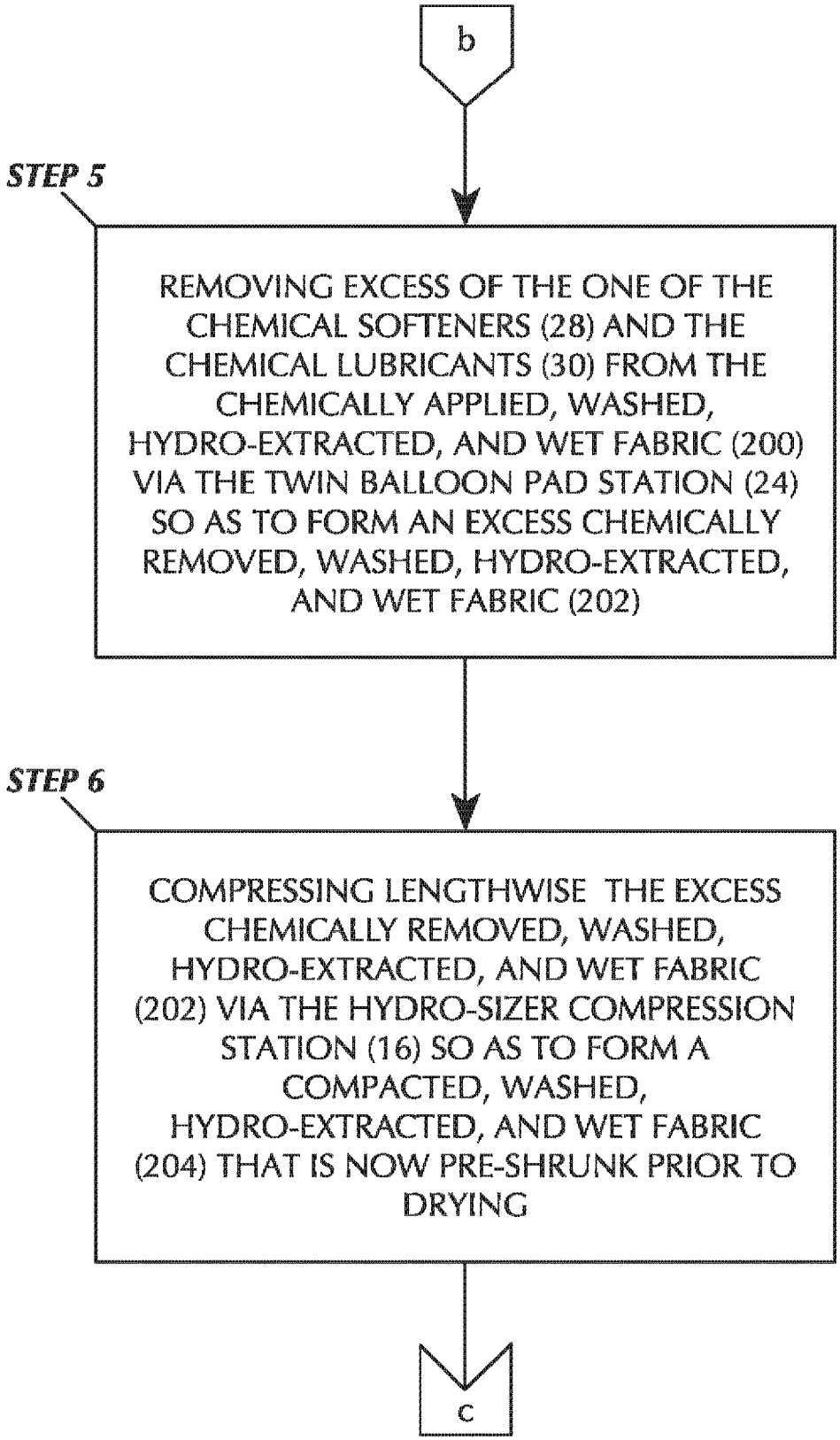
Figure 5D:
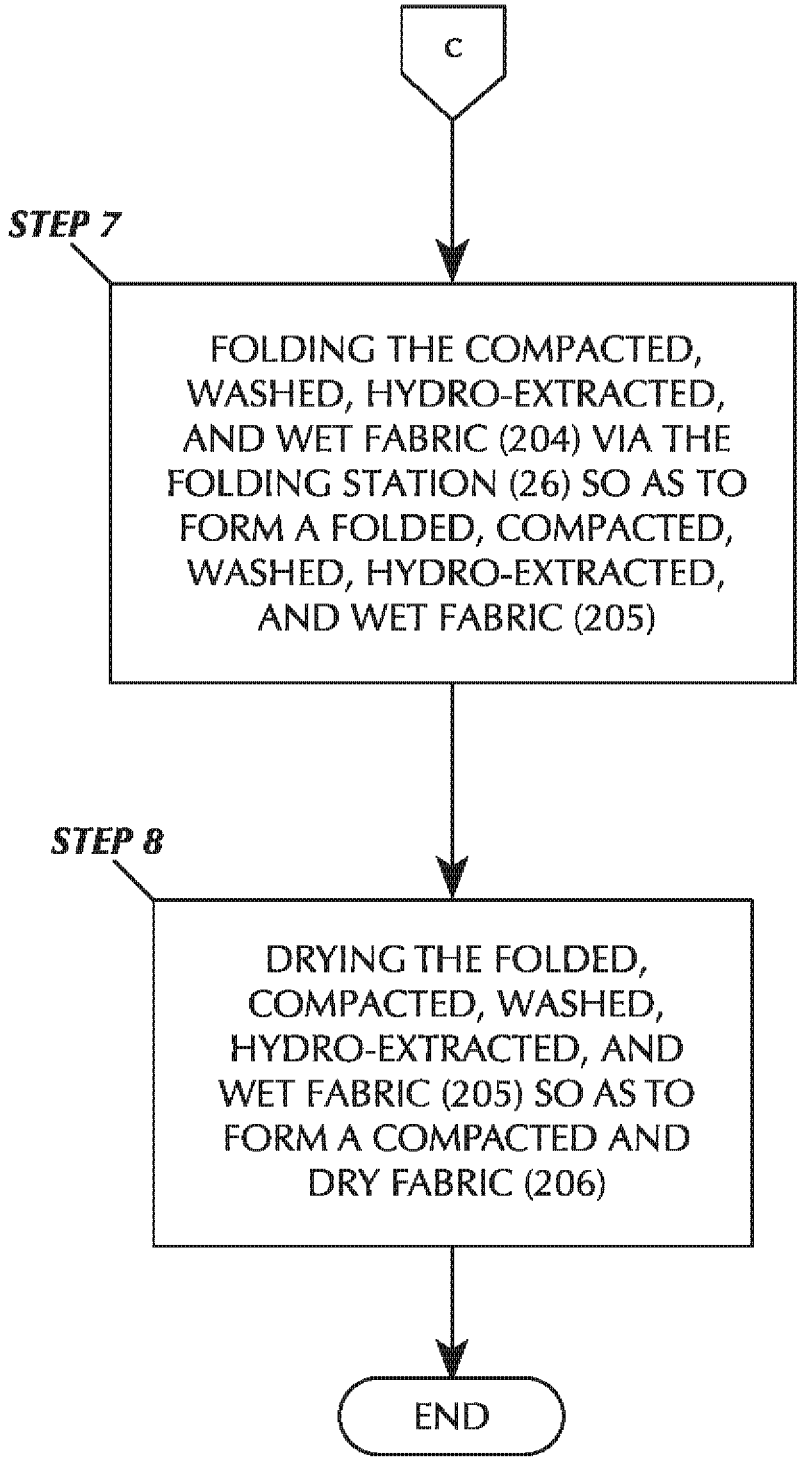

The specific configuration of the twin balloon pad station 24 can best be seen in FIGS. 3 and 4, and as such, will be discussed with reference thereto.

The twin balloon pad station 24 includes an extracting scray 124. The extracting scray 124 of the twin balloon pad station 24 is for automatic speed control and air for ballooning the wet fabric 12.

The extracting scray 124 of the twin balloon pad station 24 has an idler/dancer assembly 126.

The twin balloon pad station 24 further includes a pair of extracting squeeze rolls 128. Each extracting squeeze roll 128 of the twin balloon pad station 24 has a 7" (17.78 cm) diameter and a 38" (96.52 cm) face.

The twin balloon pad station 24 further includes a chemical application pan 130.

The chemical application pan 130 of the twin balloon pad station 24 is made from stainless steel, and has air for ballooning the wet fabric 12.

The twin balloon pad station 24 further includes a processing scray 132. The processing scray 132 of the twin balloon pad station 24 is for automatic speed control, and has an idler/dance assembly 134.

The twin balloon pad station 24 further includes a pair of padding rolls 136. Each padding roll 136 of the twin balloon pad station 24 has a 7" (17.78 cm) diameter and a 38" (96.52 cm) face.

The twin balloon pad station 24 further includes a solution controller 138. The solution controller 138 of the twin balloon pad station 24 is for automatic control of volume of the one of the chemical softeners 28 and the chemical lubricants 30.

The twin balloon pad station 24 further includes after-spreaders 140.

The after-spreaders 140 of the twin balloon pad station 24 have a pair of spreaders 142.

The pair of spreaders 142 of the after-spreaders 140 of the twin balloon pad station 24 have powered width change 144 and hole detectors 146.

Each extracting squeeze roll 128 of the twin balloon pad station 24 and each padding roll 136 of the twin balloon pad station 24 is made from one of a metal 148 and a metal core 150 covered in one of a polyurethane 152, rubber 154, and other synthetic compounds 156.

Specific Configuration of the Hydro-Sizer Compression Station 16

The specific configuration of the hydro-sizer compression station 16 can best be seen in FIGS. 3 and 4, and as such, will be discussed with reference thereto.

The hydro-sizer compression station 16 includes an edge-drive spreading unit 158, a pair of spreaders 160, a feed roll 166, a retard roll 168, and a shoe assembly 170. The shoe assembly 170 of the hydro-sizer compression station 16 is for wet compacting.

The hydro-sizer compression station 16 is for compressing the wet fabric 12 in the lengthwise direction, and in so doing, pre-shrinks the wet fabric 12 prior to drying, through independent speed control of the feed roll 166 of the hydro-sizer compression station 16 and the retard roll 168 of the hydro-sizer compression station 16.

The pair of spreaders 160 of the hydro-sizer compression station 16 have powered width change 162 and hole detectors 164.

The shoe assembly 170 of the hydro-sizer compression station 16 has a lower impact blade/shoe 172.

The lower impact blade/shoe 172 of the shoe assembly 170 of the hydro-sizer compression station 16 is made from one of metal 184 and synthetic polymers 186.

Each of the feed roll 166 of the hydro-sizer compression station 16 and the retard roll 168 of the hydro-sizer compression station 16 is made from the one of a metal 174 and a metal core 176 covered in one of polyurethane 178, rubber 180, and other synthetic compounds 182.

The feed roll 166 of the hydro-sizer compression station 16, the retard roll 168 of the hydro-sizer compression station 16, and the lower impact blade/shoe 172 of the shoe assembly 170 of the hydro-sizer compression station 16 can be heated or cooled in order to be operated at a controlled temperature ranging from 50-400° F.

Specific Configuration of the Folding Station 26

The specific configuration of the folding station 26 can best be seen in FIGS. 3 and 4, and as such, will be discussed with reference thereto.

The folding station 26 includes a self-adjusting and descending-rate drop table 188 and a fabric transport conveyor 190. The fabric transport conveyor 190 of the folding station 26 is for delivering the wet fabric 12 to the self-adjusting and descending-rate drop table 188 of the folding station 26, and includes a top 192.

The self-adjusting and descending rate-drop table 188 of the folding station 26 is for controlling distance of travel of the wet fabric 12 from the top 192 of the fabric transport conveyor 190 of the folding station 26 to the self-adjusting and descending-rate drop table 188 of the folding station 26 for preventing compaction percentage of length tension of the wet fabric 12 hanging from the fabric transport conveyor 190 of the folding station 26 from being one of reduced and pulled out.

Method 194 for Pre-Shrinking the Wet Fabric 12 Prior to Drying

The method 194 for pre-shrinking the wet fabric 12 prior to drying can best be seen in FIGS. 5A-5D, and as such, will be discussed with reference thereto.

The method 194 for pre-shrinking the wet fabric 12 prior to drying comprises the steps of:

STEP 1: Entering the wet fabric 12 into the balloon extractor station 14 via the entry system station 20 so as to form an entered and wet fabric 195;

STEP 2: Extracting some of the water 18 from the entered and wet fabric 195 via the balloon extractor station 14 so as to form a hydro-extracted and wet fabric 196;

STEP 3: Washing the hydro-extracted and wet fabric 196 via the knit washer station 22 so as to form a washed, hydro-extracted, and wet fabric 198;

STEP 4: Applying one of the chemical softeners 28 and the chemical lubricants 30 to the washed, hydro-extracted, and wet fabric 198 via the twin balloon pad station 24 so as to form a chemically applied, washed, hydro-extracted, and wet fabric 200;

STEP 5: Removing excess of the one of the chemical softeners 28 and the chemical lubricants 30 from the chemically applied, washed, hydro-extracted, and wet fabric 200 via the twin balloon pad station 24 so as to form an excess chemically removed, washed, hydro-extracted, and wet fabric 202;

STEP 6: Compressing lengthwise the excess chemically removed, washed, hydro-extracted, and wet fabric 202 via the hydro-sizer compression station 16 so as to form a compacted, washed, hydro-extracted, and wet fabric 204 that is now pre-shrunk prior to drying;

STEP 7: Folding the compacted, washed, hydro-extracted, and wet fabric 204 via the folding station 26 so as to form a folded, compacted, washed, hydro-extracted, and wet fabric 205; and STEP 8: Drying the folded, compacted, washed, hydro-extracted, and wet fabric 205 so as to form a compacted and dry fabric 206.

Empirical Data

On a typical 100% cotton jersey knit construction with 30/1 S yarn, the courses per inch (CPI) or stitches per inch vary from 44-47 after extraction and chemical application. Compacting the fabric in the "wet" state after the extraction and chemical process between 10-25% increases the CPI to 50-52 CPI.

Drying allows for further shrinkage occurrences, and the final dry compacting process only needs to add 1-2 CPI or 5-10% compaction to the fabric. With a standard finished CPI of 52, an end result of 52-54 CPI is possible. This allows for actual growth in the lengthwise direction instead of shrinkage.

The amount of compaction or compression in the lengthwise direction is adjustable allowing targeting a specific CPI. Previous methods of dry compacting will not afford these same low shrinkage or growth conditions.

Please see FIG. 6 for a tabulation of initial test results achieved by the method and apparatus of the embodiments of the present invention.

Advantages of the Method 194 and the Apparatus 10 For Pre-shrinking the Wet Fabric 12 Prior to Drying

- The compression of the fabric in the lengthwise direction in the wet state reduces the amount of lengthwise compression required in the final dry compacting stage of the finished fabric. This reduces the likelihood that top-to-bottom shine or shade change or overall shine and/or shade change or shade loss occurs.
- The continual process avoids dye migration that would render the fabric with major quality defects, such as, lengthwise compression of the fabric, as the extraction-chemical application-compacting process is continual.
- The compaction of the fabric in the lengthwise direction in the wet state prior to drying imparts lower residual shrinkage after drying. This reduces the compaction requirement of the fabric in the lengthwise direction in the final finishing process, and thus, increases and improves the stability of the finished fabric during cutting and sewing.
- The compaction of the fabric in the lengthwise direction in the wet state prior to drying achieves the final finished fabric requirements and eliminates a need for a final compacting or finishing process in certain cases. This fabric could pass directly from the drying process to the cutting and sewing process.
- The compaction of the fabric in the lengthwise direction in the wet state reduces the number of yards in the lot in process, and thus, increases the productive efficiency of the dryer as there are less yards in process.

Impressions

It will be understood that each of the elements described above or two or more together may also find a useful application in other types of constructions differing from the types described above.

While the embodiments of the present invention have been illustrated and described as embodied in a method and apparatus for pre-shrinking a wet fabric prior to drying, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An apparatus for pre-shrinking a wet fabric prior to drying, comprising:

a) a balloon extractor station;

b) a hydro-sizer compression station; and c) an entry system station;

wherein said balloon extractor station is for removing some water from the wet fabric;

wherein said hydro-sizer compression station is operatively connected to said balloon extractor station;

wherein said hydro-sizer compression station is disposed downstream of said balloon extractor station;

wherein said hydro-sizer compression station is for compressing the wet fabric in a lengthwise direction, and in so doing, pre-shrinks the wet fabric prior to drying;

wherein said entry system station includes "O" ring guiders; and wherein said "O" ring guiders of said entry system station have powered width control;

wherein said balloon extractor station is operatively connected to said entry system station;

wherein said balloon extractor station is disposed downstream of said entry system station;

wherein said entry system station includes:

a) an hydraulic turntable;

b) a twist sensor;

c) a driven cloth lifter; and d) a motorized pot-eye de-twister;

wherein said "O" ring guiders of said entry system station have hole detectors;

wherein said twist sensor of said entry system station is for automatic de-twisting; and wherein said driven cloth lifter of said entry system station is for automatic de-twisting.

2. The apparatus of claim 1, further comprising a knit washer station;

wherein said knit washer station is operatively connected to said balloon extractor station; and wherein said knit washer station is disposed downstream of said balloon extractor station.

3. The apparatus of claim 2, further comprising a twin balloon pad station;

wherein said twin balloon pad station pads on one of a chemical softener or a chemical lubricant;

wherein said one of said chemical softener of said twin balloon pad station and said chemical lubricant of said twin balloon pad station includes a non-ionic agent, a cationic agent, a polyethylene agent, a silicone, or a soil and stain release agent;

wherein said twin balloon pad station is for removing excess water and excess of said one of said chemical softener of said twin balloon pad station and said chemical lubricant of said twin balloon pad station from the wet fabric;

wherein said twin balloon pad station is operatively connected to said knit washer station;

wherein said twin balloon pad station is disposed downstream of said knit washer station;

wherein said hydro-sizer compression station is operatively connected to said twin balloon pad station; and wherein said hydro-sizer compression station is disposed downstream of said twin balloon pad station.

4. The apparatus of claim 3, wherein said twin balloon pad station includes an extracting scray;

wherein said extracting scray of said twin balloon pad station is for automatic speed control and for air ballooning the wet fabric; and wherein said extracting scray of said twin balloon pad station has an idler/dancer assembly.

5. The apparatus of claim 3, wherein said twin balloon pad station includes: a) a pair of padding rolls; b) a solution controller; and c) after-spreaders; wherein said solution controller of said twin balloon pad station automatically controls volume of one of a chemical softener or a chemical lubricant; wherein said after-spreaders of said twin balloon pad station have a pair of spreaders; and wherein said pair of spreaders of said after-spreaders of said twin balloon pad station have: a) powered width change; and b) hole detectors.

6. The apparatus of claim 5, wherein each extracting squeeze roll of said pair of extracting squeeze rolls of said twin balloon pad station and each padding roll of said pair of padding rolls of said twin balloon pad station is made from a metal or a metal core covered in polyurethane, rubber, or other synthetic compounds.

7. The apparatus of claim 2, wherein said knit washer station includes a continuous washing chamber;

wherein said continuous washing chamber of said knit washer station is made from stainless steel; and wherein said continuous washing chamber of said knit washer station has eight individual compartments.

8. The apparatus of claim 7, wherein said knit washer station includes a water heating system;

wherein said water heating system of said knit washer station has:

a) a heat exchanger; and b) a steam control valve;

wherein said steam control valve of said water heating system of said knit washer station has a remote temperature detector; and wherein said remote temperature detector of said steam control valve of said water heating system of said knit washer station is for water temperature measurement in said continuous washing chamber of said knit washer station.

9. The apparatus of claim 8, wherein said water heating system of said knit washer station has:

a) a temperature controller;

b) piping; and c) fittings;

wherein said piping and said fittings of said water heating system of said knit washer station connect said steam control valve of said water heating system of said knit washer station to said continuous washing chamber of said knit washer station; and wherein said temperature controller of said water heating system of said knit washer station has a control valve transducer.

10. The apparatus of claim 2, wherein said knit washer station includes a PH system;

wherein said PH system of said knit washer station has:

a) an acid circulation pump;

b) an electronic metering pump;

c) integral piping; and d) a PH probe; and wherein said PH probe of said PH system of said knit washer station has a transmitter.

11. The apparatus of claim 2, wherein said knit washer station includes a soap dispensing system; and wherein said soap dispensing system of said knit washer station has:

a) an electronic metering pump; and b) integral piping.

12. The apparatus of claim 1, wherein said balloon extractor station includes a driven feed roll;

wherein said driven feed roll of said balloon extractor station is for drawing the wet fabric through ring guides and into a pre-wet extracting scray;

wherein said balloon extractor station includes an extracting scray;

wherein said extracting scray of said balloon extractor station is for automatic speed control and for providing air ballooning the wet fabric; and wherein said extracting scray of said balloon extractor station has an idler/dancer assembly.

13. The apparatus of claim 1, wherein said balloon extractor station includes a pair of extracting squeeze rolls; and wherein each extracting squeeze roll of said balloon extractor station is made from a metal or a metal core covered in polyurethane, rubber, or other synthetic compounds.

14. The apparatus of claim 1, wherein said hydro-sizer compression station includes:

a) an edge-drive spreading unit;

b) a pair of spreaders;

c) a feed roll;

d) a retard roll; and e) a shoe assembly;

wherein said shoe assembly of said hydro-sizer compression station is for wet compacting;

wherein said hydro-sizer compression station is for compressing the wet fabric in the lengthwise direction, and in so doing, pre-shrinks the wet fabric prior to drying through independent speed control of said feed roll of said hydro-sizer compression station and said retard roll of said hydro-sizer compression station;

wherein said pair of spreaders of said hydro-sizer compression station have:

a) powered width change; and b) hole detectors; and wherein said shoe assembly of said hydro-sizer compression station has a lower impact blade/shoe.

15. The apparatus of claim 14, wherein said feed roll of said hydro-sizer compression station and said retard roll of said hydro-sizer compression station is made from a metal or a metal core covered in polyurethane, rubber, or other synthetic compounds; and wherein said lower impact blade/shoe of said shoe assembly of said hydro-sizer compression station is made from a metal or synthetic polymers.

16. The apparatus of claim 1, further comprising a folding station;

wherein said folding station includes:

a) a self-adjusting and descending-rate drop table; and b) a fabric transport conveyor;

wherein said fabric transport conveyor of said folding station has a top;

wherein said fabric transport conveyor of said folding station is for delivering the wet fabric to said self-adjusting and descending-rate drop table of said folding station; and wherein said self-adjusting and descending rate-drop table of said folding station is for controlling distance of travel of the wet fabric from said top of said fabric transport conveyor of said folding station to said self-adjusting and descending-rate drop table of said folding station for preventing compaction percentage of length tension of the wet fabric hanging from said fabric transport conveyor of said folding station from being one of reduced or pulled out.

* * * * *